United States Patent [19]

Billings et al.

[11] Patent Number: 4,458,883

[45] Date of Patent: Jul. 10, 1984

[54] MOLTEN METAL FUME SUPPRESSION

[75] Inventors: Laird D. Billings; LaMar S. Hills, Jr., both of Orem; Jay R. Hopkins, Provo, all of Utah

[73] Assignee: United States Steel Corporation, Pittsburg, Pa.

[21] Appl. No.: 325,460

[22] Filed: Nov. 27, 1981

[51] Int. Cl.[3] ..... C21B 7/10; C21C 5/38

[52] U.S. Cl. ..... 266/44; 75/60; 75/96

[58] Field of Search ..... 75/60, 96; 266/44

[56] References Cited

U.S. PATENT DOCUMENTS

| | | | |
|---|---|---|---|
| 3,960,546 | 6/1976 | Rote | 75/60 |
| 3,970,446 | 7/1976 | Kolb | 75/60 |
| 3,997,335 | 12/1976 | Kolb | 75/60 |
| 3,999,977 | 12/1976 | Kolb | 75/60 |
| 4,040,819 | 8/1977 | Rounds | 75/60 |
| 4,047,936 | 9/1977 | Chang | 75/60 |
| 4,294,432 | 10/1981 | Blair | 75/60 |

*Primary Examiner*—Peter D. Rosenberg

*Attorney, Agent, or Firm*—John F. Carney

[57] ABSTRACT

A method is described for suppressing fume generated in the transfer of molten metal to a receiver. The involved method entails burning fuel in the immediate vicinity of the molten bath within the receiver to consume and/or displace ambient air thereby to starve the bath of oxygen and, concomitantly, to suppress the formation of the fume-producing metallic oxide.

7 Claims, 6 Drawing Figures

MOLTEN METAL FUME SUPPRESSION

BACKGROUND OF THE INVENTION

The present invention pertains to the suppression of undesirable fugitive emissions or fume that is prevalent in the pouring of molten metal, particularly that of iron or steel.

When molten metals are poured from one container to another in various metal production processes the pouring is accompanied by the emission from the receiving container of large amounts of fume. One typical example is the transfer of refined steel into a receiving ladle upon tapping of the converter or steelmaking furnace. The generation of such fugitive emissions constitutes a serious atmospheric pollution problem, the abatement of which represents a significant part of the cost of performing many metallurgical processes.

Much effort and expense has been expended in the development of emission control systems that are effective to maintain the volume of fugitive emissions associated with molten metal pouring within acceptable limits. Past efforts include the development of various forms of air or gas curtains and fume exhaust equipment adapted to isolate the affected region of the plant and to conduct the undesirable effluent to treating apparatus prior to its discharge into the atmosphere. Such prior art developments are exemplified by U.S. Pat. Nos. 3,396,954, granted Aug. 13, 1968 to Krogsrud; 3,834,293, granted Sept. 10, 1974 to Danieli; and 3,994,210, granted Nov. 24, 1975 to Davis. These systems all rely on the capture and disposal of the fugitive fume and, while being effective to a limited degree in solving the concerned problem, entail significant capital expenditure to install and are costly to operate.

Japanese Pat. No. 53-6602, granted Mar. 9, 1978 to Nippon Steel Corporation, on the other hand, teaches an emission control system in which fugitive fume is sought to be suppressed by blanketing the molten bath with an inert gas, such as steam or nitrogen, to retard metallic oxide formation. A yet more effective system for suppressing fume is described in U.S. patent application Ser. No. 286,395 filed July 23, 1981 by Ball et al. and assigned to the assignee herein, wherein a mixture of water and inert gas is injected into the receiver over the molten bath for fume suppression. This latter system, although most effective in suppressing fume, is not without some attendant disadvantages. For example, unless appropriate precautions are taken, the presence of steam in the vicinity of a molten bath is potentially dangerous due to the possibility of condensate leakage into the bath and the creation of an explosive condition.

Another problem with fume suppression by steam blanketing arises due to the fact that steam, being at a significantly lower temperature than the molten bath, tends to chill the bath thereby resulting in the release of free carbon flakes, termed "kish", that, unless captured, permeate the atmosphere surrounding the receiver.

Still another problem attendant with the use of steam as a fume suppressant is that water vapor can have an adverse metallurgical effect on certain products produced from the affected metal. Specifically, it has been determined that products having thick sections, such as heavy structural members, may retain residual amounts of hydrogen acquired from the application of steam to the bath for fume suppressing purposes.

It is to the amelioration of the above problems and to the development of a more effective emission control system for molten metal teeming operations that the present invention is directed.

SUMMARY OF THE INVENTION

There is thus provided in accordance with the present invention a method of suppressing the emission of fume from a receiver vessel into which molten metal is transferred comprising the step of injecting fuel into the receiver to be burned in the vicinity of the surface of the molten bath therein.

It is, accordingly, a particular object of the invention to provide an effective method for preventing the emission of fume during the transfer of molten metal from a source to a receiving vessel.

A further object of the invention is to provide a method for reducing metal oxide fume emission by preventing contact of the molten bath by oxygen present in ambient air.

For a better understanding of the invention, its operating advantages and the specific objectives obtained by its use, reference should be made to the accompanying drawings and description which relate to preferred embodiments thereof.

DESCRIPTION OF A PREFERRED EMBODIMENT OF THE INVENTION

Figure 1:
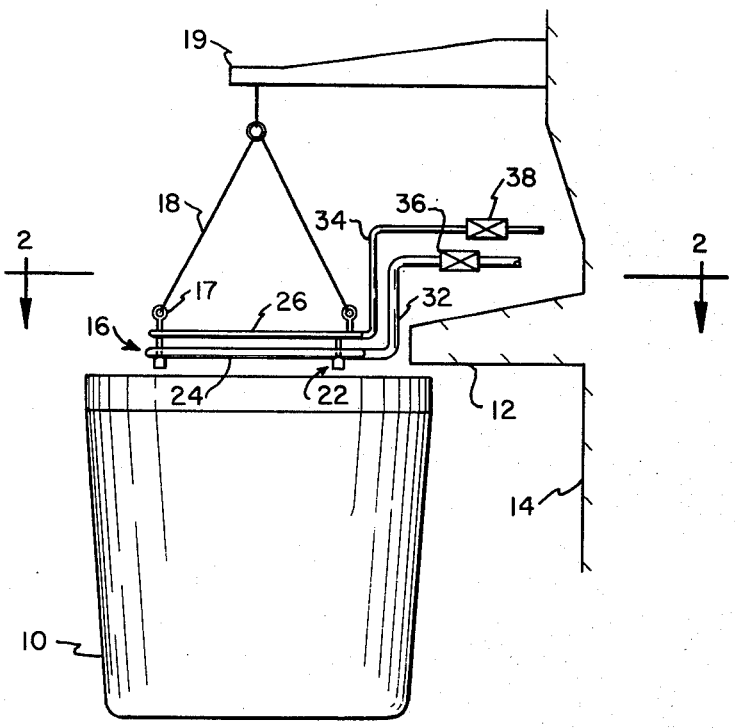
FIG. 1 is a somewhat schematic arrangement drawing illustrating apparatus according to the present invention for suppressing fume in a molten metal receiving vessel.
Figure 2:
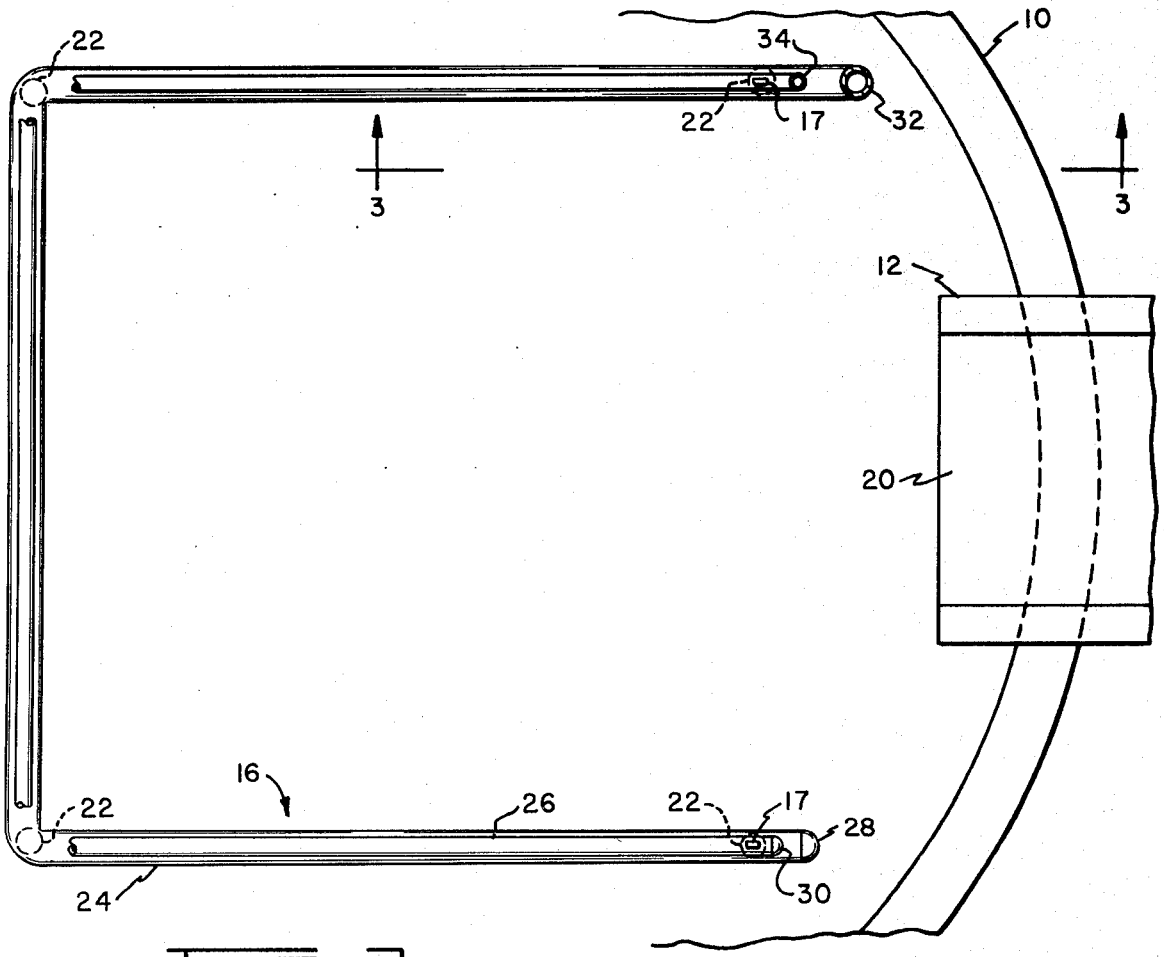
FIG. 2 is an enlarged partial plan view of the arrangement shown in FIG. 1.

To explain a typical application of the present invention there is shown in FIG. 1 a vessel 10, commonly referred to as a tapping ladle, for receiving molten metal from the discharge spout 12 of a metal-producing furnace 14, such as an open hearth furnace, or the like. It should be understood, however, that the invention is equally applicable to other metal-pouring applications, especially those in which molten metal is transferred into a receiving vessel, such as, for example, from a ladle into a furnace, or vice versa.

As is well known, the pouring of molten metal into a receiver, be it a furnace, a converter, a ladle, an ingot, a continuous caster, or the like, is accompanied by the generation of undesirable fume that is emitted from the vessel and creates a polluting atmosphere in the surrounding area. Such fume essentially comprises finely divided oxides of the metal being poured, as well as dust particles that may be mixed with gaseous contaminants.

In order to abate this problem, in the arrangement of FIG. 1 there is provided fume suppression apparatus 16 suspended via bails 17 attaching chains 18 from an overhead support 19 in overlying relation to the mouth 20 of vessel 10. The apparatus 16 comprises a plurality of burners 22, here shown as being four in number arranged on ninety degree spacing, depending from a horizontally disposed elongated header assembly including parallel fuel and air headers, 24 and 26 respectively. The headers 24 and 26 are formed by three serially connected legs defining a generally C-shaped member. The open side of the assembly conveniently accommodates the molten metal stream issuing from the discharge spout 12 of furnace 14. The fuel and air headers 24 and 26 are capped, as at 28 and 30, at their respective leading ends and at their trailing ends connect through risers 32 and 34 containing regulating valves 36 and 38 to sources of fuel and compressed air respectively. It is contemplated that any fluid fuel may be utilized in the operation of the apparatus, however, gaseous fuels such as natural gas and gases obtained as by-products from the operation of coke ovens and blast furnaces may also be advantageously employed.

Figure 3:
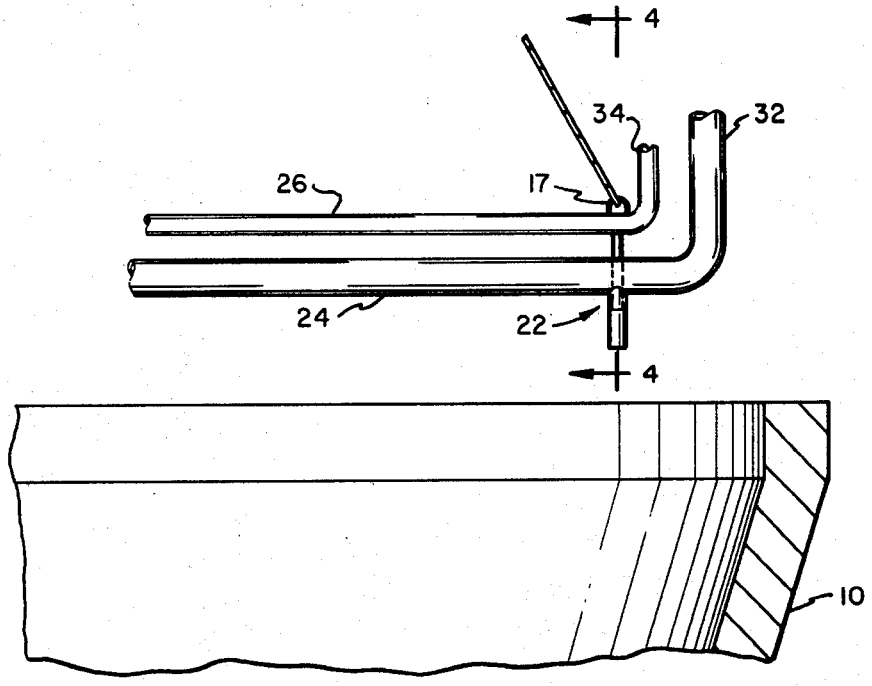
FIG. 3 is a partial elevational view of the arrangement of FIG. 2.
Figure 4:
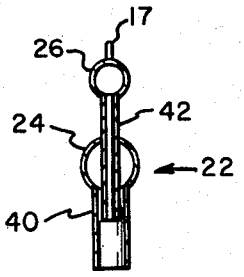
FIG. 4 is a sectional view taken along line 4—4 of FIG. 3.

As shown in FIGS. 3 and 4, each burner apparatus 22 comprises concentrically disposed fuel and air supply tubes 40 and 42, that communicate at one end each with the fuel header 24 and air header 26, respectively. The fuel supply tube 40 surrounds the discharge end of air supply tube 42 such that air discharged under pressure from header 26 serves to inspirate fuel from the header 24 and mix therewith in the fuel supply tube 40 prior to ejection from the discharge end thereof into the interior of the vessel 10 for burning therein.

In an operative installation fuel in the form of natural gas, at a line pressure of about eight psi and compressed air at a line pressure of about ninety psi are supplied to the burners 22 for ejection into the interior of the vessel 10 as molten metal is poured therein. Gas and air are ejected from the burners 22 at a rate to insure the delivery of fuel and combustion thereof at least in close proximity to the surface of the molten bath that develops in the bottom of the vessel 10.

Although the mechanism by which suppression of fume is accomplished is not completely understood, it is believed that the effect is largely accomplished by the expurgation of ambient air from that region of the vessel interior immediately adjacent the bath thereby preventing oxygen-contact with the molten metal. Expurgation of air may be accomplished by the combustion gases produced by the burning fuel physically displacing the air from the vicinity of the bath. Alternatively, it is believed that an oxygen-free atmosphere adjacent the molten metal bath may be achieved by the fuel's consuming the ambient air during combustion. Whatever the reason the generation of a flame within the receiver has a very substantial effect on suppressing fume that is otherwise attendant in the pouring of molten metal.

In achieving the above advantageous results, it is further believed that the function of the compressed air is simply to provide a vehicle or carrier for delivering the fuel gas to the surface of the bath. This may be borne out by the fact that the supply of compressed air to the burners 22 can be reduced in response to the rising level of metal in the bath as pouring proceeds without adversely affecting fume suppression.

Figure 5:
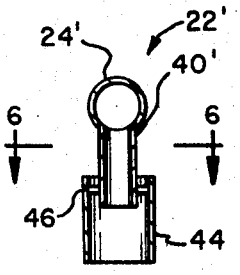
FIG. 5 is a sectional view similar to FIG. 4 illustrating alternative apparatus for use in the practice of the invention.
Figure 6:
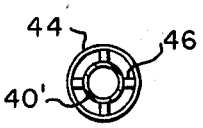
FIG. 6 is a sectional view taken along line 6—6 of FIG. 5.

Not surprisingly, therefore, where adequate fuel pressures, for example, of the order of about fifteen psi are available, the advantageous results of the invention have been achieved by the introduction of gaseous fuel without compressed air to the receiver. Thus, in FIGS. 5 and 6 is shown an alternative form of burner apparatus indicated as 22', capable of producing results similar to those achieved from use of the burners 22 of FIGS. 1 through 4. In this form of the invention, fuel from the fuel header 24' is discharged via supply tubes 40' into the vessel interior as molten metal is supplied thereto. As shown, the discharge ends of the supply tubes 40' may each be advantageously enclosed by a cylindrical sleeve 44 that is concentrically spaced from the tube by radially extending ribs 46 to define an annular space through which ambient air about the respective burners 22' can be aspirated into the gas flow stream for mixing therewith in order to promote combustion and to extend the flame produced thereby into the vessel interior.

From the foregoing, it should be appreciated that the hereindescribed invention affords a simple, yet effective means for abating a serious pollution problem that exists substantially everywhere that molten metal is poured from a source to a receiver. The apparatus required for practice of the invention is, moreover, inexpensive to install and to operate as compared with prior art apparatus previously employed for the purpose of abating pollution attendant with molten metal pouring.

It will be understood that various changes in the details, materials and arrangements of parts which have been herein described and illustrated in order to explain the nature of the invention, may be made by those skilled in the art within the principle and scope of the invention as expressed in the appended claims.

What is claimed is :

1. The method of supressing the emission of fume from a receiver vessel into which molten metal is transferred and over the mouth of which is disposed at least one burner adapted for combusting fuel and pressurized air for combustion comprising the steps of:

(a) simultaneously supplying fuel and air to said burners as molten metal is poured into said vessel; and (b) gradually reducing the supply of air to said burner as the level of molten metal rises in said vessel.

2. Method for suppressing metal oxide fume generated during the transfer of molten metal to a receiver by combination of metal vapors from the transferred metal with the oxygen content of ambient air existant in the interior of said receiver vessel, said method comprising the (a) transferring molten metal from the exterior of said receiver to the interior thereof;

(b) simultaneously therewith, injecting fluid fuel in the absence of excess air for burning into the region of said receiver overlying the surface of the body of transferred molten metal therein, said fluid fuel being in amounts sufficient to consume by combustion the ambient air occupying said overlying region whereby said receiver interior is deprived of oxygen with which to combine with said metal vapors to generate said metal oxide fume; and (c) continuing the injection of said fluid fuel in said amounts into said receiver for so long as molten metal is transferred thereinto.

3. The method according to claim 2 in which said injected fuel is gaseous.

4. The method according to any one of claims 1, 2 or 3 in which said fuel is injected into said receiver into wiping relation with the surface of the molten bath therein.

5. The method according to claim 4 in which fuel is injected into said vessel from a pressurized source.

6. The method according to claim 4 in which fuel is injected into a stream of compressed air for delivery to an operative level in said receiver.

7. The method according to claim 6 in which said mixture of fuel and air is fuel-rich.

* * * * *